US008764149B1

(12) United States Patent
Shin et al.

(10) Patent No.: US 8,764,149 B1
(45) Date of Patent: Jul. 1, 2014

(54) SYSTEM AND METHOD FOR PROCESS DIRECTION REGISTRATION OF INKJETS IN A PRINTER OPERATING WITH A HIGH SPEED IMAGE RECEIVING SURFACE

(71) Applicant: Xerox Corporation, Norwalk, CT (US)

(72) Inventors: Helen Haekyung Shin, Fairport, NY (US); Howard A. Mizes, Pittsford, NY (US); Jeffrey J. Folkins, Rochester, NY (US); Yeqing Zhang, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/743,618

(22) Filed: Jan. 17, 2013

(51) Int. Cl.
*B41J 29/38* (2006.01)

(52) U.S. Cl.
USPC ..... 347/14

(58) Field of Classification Search
USPC ..... 347/5, 14, 15, 19
See application file for complete search history.

(56) References Cited

U.S. PATENT DOCUMENTS

| | | | |
|---|---|---|---|
| 4,328,504 | A | 5/1982 | Weber et al. |
| 4,509,057 | A | 4/1985 | Sohl et al. |
| 5,075,689 | A | 12/1991 | Hoisington et al. |
| 5,160,938 | A | 11/1992 | Fargo et al. |
| 5,212,497 | A | 5/1993 | Stanley et al. |
| 5,343,231 | A | 8/1994 | Suzuki |
| 5,451,990 | A | 9/1995 | Sorenson et al. |
| 5,477,244 | A | 12/1995 | Shibata et al. |
| 5,576,744 | A | 11/1996 | Niikura et al. |
| 5,600,350 | A | 2/1997 | Cobbs et al. |
| 5,726,690 | A | 3/1998 | Bohorquez et al. |
| 5,796,414 | A | 8/1998 | Sievert et al. |
| 5,831,658 | A | 11/1998 | Iga et al. |
| 5,835,108 | A | 11/1998 | Beauchamp et al. |
| 5,847,724 | A | 12/1998 | Mantell |
| 5,903,681 | A | 5/1999 | Rueby et al. |
| 5,923,344 | A | 7/1999 | Norum et al. |
| 5,992,962 | A | 11/1999 | Yen et al. |
| 6,076,915 | A | 6/2000 | Gast et al. |
| 6,089,693 | A | 7/2000 | Drake et al. |
| 6,102,513 | A | 8/2000 | Wen |
| 6,141,114 | A | 10/2000 | Mantell et al. |
| 6,145,959 | A | 11/2000 | Lund et al. |
| 6,168,261 | B1 | 1/2001 | Miyake et al. |
| 6,196,652 | B1 | 3/2001 | Subirada et al. |
| 6,206,502 | B1 | 3/2001 | Kato et al. |
| 6,247,787 | B1 | 6/2001 | Giere et al. |
| 6,273,542 | B1 | 8/2001 | Couwenhoven et al. |
| 6,275,600 | B1 | 8/2001 | Banker et al. |
| 6,300,968 | B1 | 10/2001 | Kerxhalli et al. |
| 6,315,383 | B1 | 11/2001 | Sarmast et al. |
| 6,334,720 | B1 | 1/2002 | Kato et al. |
| 6,367,903 | B1 | 4/2002 | Gast et al. |
| 6,377,758 | B1 | 4/2002 | OuYang et al. |
| 6,390,580 | B1 | 5/2002 | Anderson et al. |

(Continued)

*Primary Examiner* — Julian Huffman
*Assistant Examiner* — Sharon A Polk
(74) *Attorney, Agent, or Firm* — Maginot, Moore & Beck, LLP

(57) ABSTRACT

A method for process direction registration in an inkjet printer includes ejecting ink drops from a first inkjet at less than a maximum operating rate onto an image receiving surface moving in a process direction. The method includes generating image data samples of the image receiving surface including the ink drops. The method further includes identifying a center of the ink drops in the process direction with reference to the image data samples and storing a time offset value in a memory to correct an identified process direction offset between the identified center of the ink drops and another identified center of ink drops that are ejected by another inkjet.

18 Claims, 5 Drawing Sheets

(56) References Cited

U.S. PATENT DOCUMENTS

| | | | |
|---|---|---|---|
| 6,464,334 | B2 | 10/2002 | Lopez et al. |
| 6,467,867 | B1 | 10/2002 | Worthington et al. |
| 6,494,558 | B1 | 12/2002 | Doval et al. |
| 6,532,026 | B2 | 3/2003 | Takahashi et al. |
| 6,554,390 | B2 | 4/2003 | Arquilevich et al. |
| 6,568,786 | B2 | 5/2003 | Sarmast et al. |
| 6,590,598 | B2 | 7/2003 | Kodama |
| 6,637,853 | B1 | 10/2003 | Ahne et al. |
| 6,764,156 | B2 | 7/2004 | Mantell |
| 6,814,425 | B2 | 11/2004 | Mott et al. |
| 6,819,352 | B2 | 11/2004 | Mizes et al. |
| 6,847,465 | B1 | 1/2005 | Wetchler et al. |
| 6,883,892 | B2 | 4/2005 | Sievert et al. |
| 6,942,313 | B2 | 9/2005 | Kanda |
| 6,993,275 | B2 | 1/2006 | Mitsuya et al. |
| 7,073,883 | B2 | 7/2006 | Billow |
| 7,090,324 | B2 | 8/2006 | Mizes |
| 7,118,188 | B2 | 10/2006 | Vilanova et al. |
| 7,254,254 | B2 | 8/2007 | Ueda et al. |
| 7,314,261 | B2 | 1/2008 | Jackson Pulver et al. |
| 7,347,525 | B2 | 3/2008 | Mizes |
| 7,367,642 | B2 | 5/2008 | Ouchi et al. |
| 7,380,897 | B2 | 6/2008 | Anderson et al. |
| 7,390,073 | B2 | 6/2008 | Bailey et al. |
| 7,391,525 | B2 | 6/2008 | Chapman et al. |
| 7,478,894 | B2 | 1/2009 | Kim et al. |
| 7,515,305 | B2 | 4/2009 | Mizes |
| 7,524,007 | B2 | 4/2009 | Pulver et al. |
| 7,524,015 | B2 | 4/2009 | Srinivasan et al. |
| 7,543,911 | B2 | 6/2009 | Mizes et al. |
| 7,549,721 | B2 | 6/2009 | Nakano et al. |
| 7,552,986 | B2 | 6/2009 | Mizes et al. |
| 7,597,418 | B2 | 10/2009 | Mantell et al. |
| 7,607,752 | B2 | 10/2009 | Childers et al. |
| 7,630,653 | B2 | 12/2009 | Bonino |
| 7,637,586 | B2 | 12/2009 | Yun |
| 7,686,298 | B2 | 3/2010 | Fioravanti et al. |
| 7,794,042 | B2 | 9/2010 | Mizes et al. |
| 2002/0135629 | A1 | 9/2002 | Sarmast et al. |
| 2003/0231350 | A1 | 12/2003 | Yamagishi |
| 2004/0160468 | A1 | 8/2004 | Kim et al. |
| 2005/0099447 | A1 | 5/2005 | Hsu et al. |
| 2009/0003729 | A1 | 1/2009 | Metcalfe et al. |
| 2009/0322849 | A1 | 12/2009 | Calamita et al. |
| 2010/0013882 | A1 | 1/2010 | Mizes et al. |
| 2010/0329756 | A1 | 12/2010 | Mizes |
| 2011/0242186 | A1 | 10/2011 | Mizes et al. |
| 2011/0242187 | A1 | 10/2011 | Mongeon et al. |
| 2011/0279505 | A1 | 11/2011 | Shin et al. |

SYSTEM AND METHOD FOR PROCESS DIRECTION REGISTRATION OF INKJETS IN A PRINTER OPERATING WITH A HIGH SPEED IMAGE RECEIVING SURFACE

TECHNICAL FIELD

The system and method disclosed in this document relates to inkjet printing systems generally, and, more particularly, to systems and methods for registering inkjets in printheads to enable ink drop registration in the inkjet printing system.

BACKGROUND

Inkjet printers have printheads configured with a plurality of inkjets that eject liquid ink onto an image receiving member. The ink may be stored in reservoirs located within cartridges installed in the printer. Such ink may be aqueous, oil, solvent-based, or UV curable ink or an ink emulsion. Other inkjet printers receive ink in a solid form and then melt the solid ink to generate liquid ink for ejection onto the imaging member. In these solid ink printers, the solid ink may be in the form of pellets, ink sticks, granules, pastilles, or other shapes. The solid ink pellets or ink sticks are typically placed in an ink loader and delivered through a feed chute or channel to a melting device that melts the ink. The melted ink is then collected in a reservoir and supplied to one or more printheads through a conduit or the like. In other inkjet printers, ink may be supplied in a gel form. The gel is also heated to a predetermined temperature to alter the viscosity of the ink so the ink is suitable for ejection by a printhead.

A typical full width scan inkjet printer uses one or more printheads. Each printhead typically contains an array of individual nozzles for ejecting drops of ink across an open gap to an image receiving member to form an image. The image receiving member may be a continuous web of recording media, a series of media sheets, or the image receiving member may be a rotating surface, such as a print drum or endless belt. Images printed on a rotating surface are later transferred to recording media by mechanical force in a transfix nip formed by the rotating surface and a transfix roller. In an inkjet printhead, individual piezoelectric, thermal, or acoustic actuators generate mechanical forces that expel ink through an orifice from an ink filled conduit in response to an electrical voltage signal, sometimes called a firing signal. The amplitude, frequency, or duration of the signals affects the amount of ink ejected in each drop. The firing signal is generated by a printhead controller with reference to electronic image data. An inkjet printer forms an ink image on an image receiving surface with reference to the electronic image data by printing a pattern of individual ink drops at particular locations on the image receiving surface. The locations where the ink drops land are sometimes called "ink drop locations," "ink drop positions," or "pixels." Thus, a printing operation can be viewed as the placement of ink drops on an image receiving surface with reference to electronic image data.

In order for the printed ink images to correspond closely to the image data, both in terms of fidelity to the image objects and the colors represented by the image data, the printheads must be registered with reference to the imaging surface and with the other printheads in the printer. Registration of printheads is a process in which the printheads are operated to eject ink in a known pattern and then the printed image of the ejected ink is analyzed to determine the orientation of the printhead with reference to the imaging surface and with reference to the other printheads in the printer. Operating the printheads in a printer to eject ink in correspondence with image data presumes that the printheads are level with a width across the image receiving member and that all of the inkjet ejectors in the printhead are operational. The presumptions regarding the orientations of the printheads, however, cannot be assumed, but must be verified. Additionally, if the conditions for proper operation of the printheads cannot be verified, the analysis of the printed image should generate data that can be used either to adjust the printheads so they better conform to the presumed conditions for printing or to compensate for the deviations of the printheads from the presumed conditions.

Analysis of printed images is performed with reference to two directions. "Process direction" refers to the direction in which the image receiving member is moving as the imaging surface passes the printhead to receive the ejected ink and "cross-process direction" refers to the direction across the width of the image receiving member that is perpendicular to the process direction. In order to analyze a printed image, a test pattern needs to be generated so determinations can be made as to whether the inkjets operated to eject ink did, in fact, eject ink and whether the ejected ink landed where the ink would have landed if the printhead was oriented correctly with reference to the image receiving member and the other printheads in the printer.

During a process direction registration operation, the inkjets in different printheads in the printer form predetermined patterns, which are referred to as "test patterns," on the image receiving surface. Each inkjet ejects a plurality of drops in rapid succession as the image receiving surface moves in the process direction to form the test pattern with an arrangement of printed dashes, where each dash includes the ink drops ejected from a single inkjet and arranged in the process direction. An optical sensor in the printer generates image data corresponding to the printed dashes in the test pattern, and the printer adjusts the time of operation for inkjets in each of the printheads so that ink drops from multiple print heads are aligned in the process direction to enable production of high quality printed images.

Existing process direction registration techniques begin to lose effectiveness as the linear velocity of the image receiving surface increases. For example, in some printer embodiments existing process direction registration techniques become less effective as the linear velocity of a paper media web moving past the printheads in the process direction approaches and exceeds approximately 152 meters per minute (500 feet per minute). Increased image receiving surface speeds produce a corresponding increase in the throughput of the printer, but may also decrease the quality of printed images. For example, the increased media web velocity accentuates process direction drop placement errors because the media web moves a longer distance during a given time period. Thus, a time offset between inkjets in one or more printheads that is acceptable for use in lower-speed printer configurations is no longer acceptable as the linear velocity of the media web increases. Additionally, drop placement measurements extracted from the existing printed test patterns lose accuracy when the optical sensor in the printer generates image data of the test patterns at the increased web velocity due to decreased process direction resolution that results in aliasing of the printed dashes in the image data. Consequently, improved methods for performing process direction registration for printheads would be beneficial.

SUMMARY

In one embodiment, a method of operating an inkjet printer to register inkjets in a process direction has been developed.

The method includes moving an image receiving surface in a process direction past a printhead and an optical sensor, and ejecting a plurality of drops from a first inkjet in the printhead at a first predetermined rate onto the image receiving surface, the first rate of ejecting the ink drops from the first inkjet being less than a maximum ejection rate of the first inkjet. The method also generates with the optical sensor a plurality of image data samples of the image receiving surface that include a plurality of portions of the image receiving surface that received the plurality of drops ejected from the first inkjet, and the plurality of image data samples are generated at a second predetermined rate, the second predetermined rate being less than the maximum ejection rate of the first inkjet to enable at least one image data sample between two image data samples depicting an ink drop to depict a portion of the image receiving surface that does not have an ink drop. A center of the plurality of ink drops on the image receiving surface in the process direction is identified with reference to the plurality of image data samples, and a process direction offset between the identified center of the plurality of drops ejected from the first inkjet and a center identified with reference to another plurality of image data samples generated for another portion of the image receiving surface having a plurality of ink drops that were ejected by a second inkjet is also identified. An image data offset value corresponding to the identified offset is stored in a memory in association with the first inkjet.

In another embodiment, an inkjet printer that is configured to register inkjets in a printhead in a process direction has been developed. The printer includes a media transport configured to move a print medium in a process direction past a printhead having a plurality of inkjets and an optical sensor, and a controller operatively connected to the media transport, the printhead, the optical sensor, and a memory. The controller is configured to operate the media transport to move the print medium past the printhead and the optical sensor at a predetermined rate, generate firing signals to eject a plurality of drops from a first inkjet in the printhead at a first predetermined rate onto the print medium, the first rate of ejecting the ink drops from the first inkjet being less than a maximum ejection rate of the first inkjet, generate with the optical sensor a plurality of image data samples of the print medium including a plurality of portions of the print medium that received the plurality of drops ejected from the first inkjet, the plurality of image data samples being generated at a second predetermined rate. The second predetermined rate is less than the maximum ejection rate of the first inkjet to enable at least one image data sample between two image data samples depicting an ink drop to depict a portion of the image receiving surface that does not have an ink drop. The controller is also configured to identify a center of the plurality of ink drops on the print medium in the process direction with reference to the plurality of image data samples, identify a process direction offset between the identified center of the plurality of drops ejected from the first inkjet and a center identified with reference to another plurality of image data samples generated for another portion of the image receiving surface having another plurality of ink drops ejected by a second inkjet, and store a timing adjustment value corresponding to the identified offset in the memory in association with the first inkjet.

BRIEF DESCRIPTION OF THE DRAWINGS

An exemplary embodiment of this application will now be described, by way of example, with reference to the accompanying drawings, in which like reference numerals refer to like elements, and in which.

DETAILED DESCRIPTION

Figure 1:
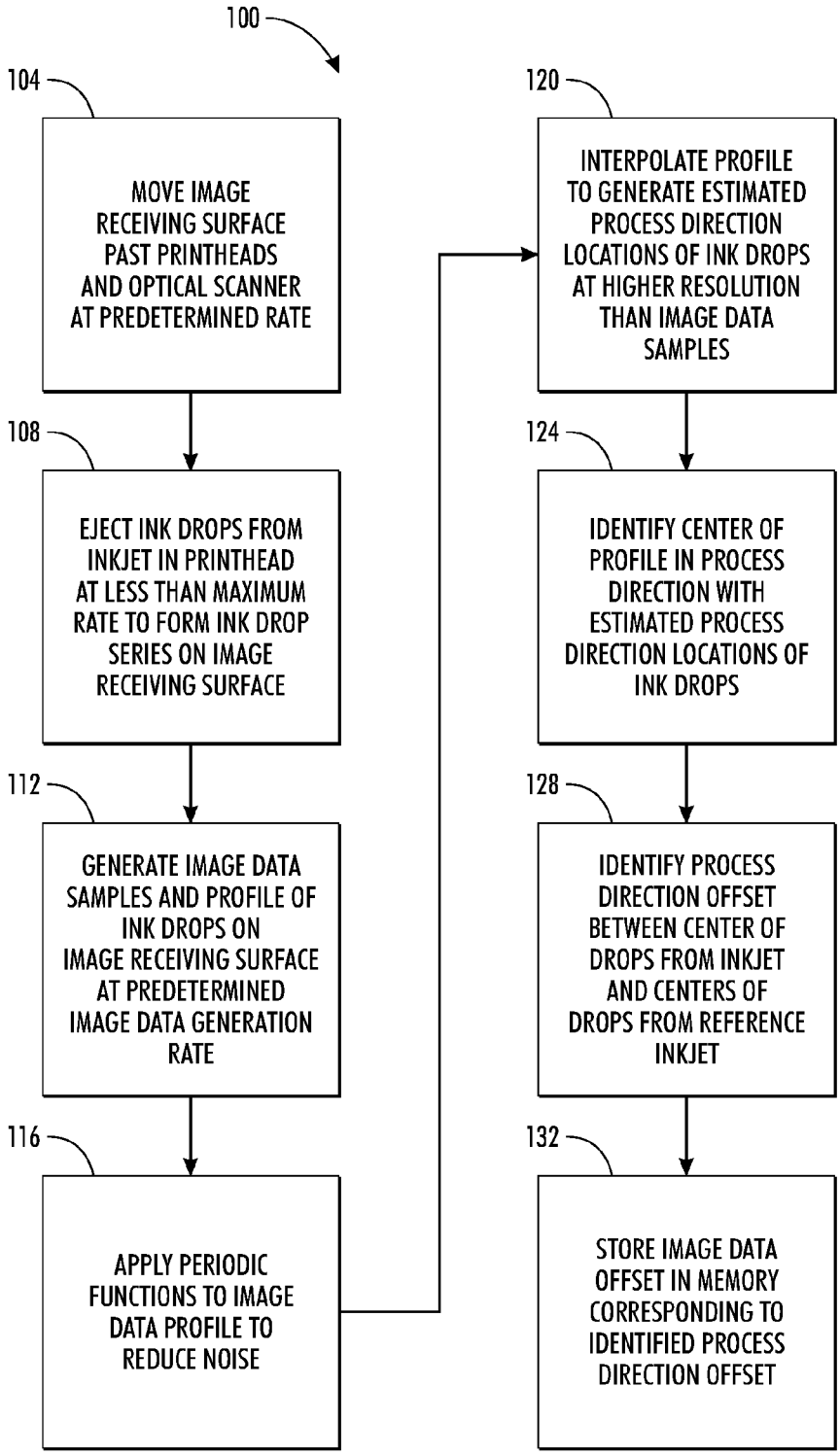
FIG. 1 is a block diagram of a process for performing process direction registration of inkjets in a printhead that is arranged in a print zone of an inkjet printer.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces images with colorants on media, such as digital copiers, bookmaking machines, facsimile machines, multi-function machines, and the like. As used herein, the term "process direction" refers to a direction of movement of a print medium, such as a continuous media web pulled from a roll of paper or other suitable print medium along a media path through a printer. A media transport in the printer uses one or more actuators, such as electric motors, to move the print medium past one or more printheads in the print zone to receive ink images and passes other printer components, such as heaters, fusers, pressure rollers, and on-sheet optical imaging sensors, that are arranged along the media path. As used herein, the term "cross-process" direction refers to an axis that is perpendicular to the process direction along the surface of the print medium.

As used herein, the term "phase change ink" refers to a form of ink that is substantially solid at room temperature and transitions to a liquid state when heated to a phase change ink melting temperature for ejecting onto the image receiving member surface. The phase change ink melting temperature is any temperature that is capable of melting solid phase change ink into liquid or molten form. The phase change ink returns to the solid state after cooling on a print medium, such as paper, to form a printed image on the print medium.

Figure 4:
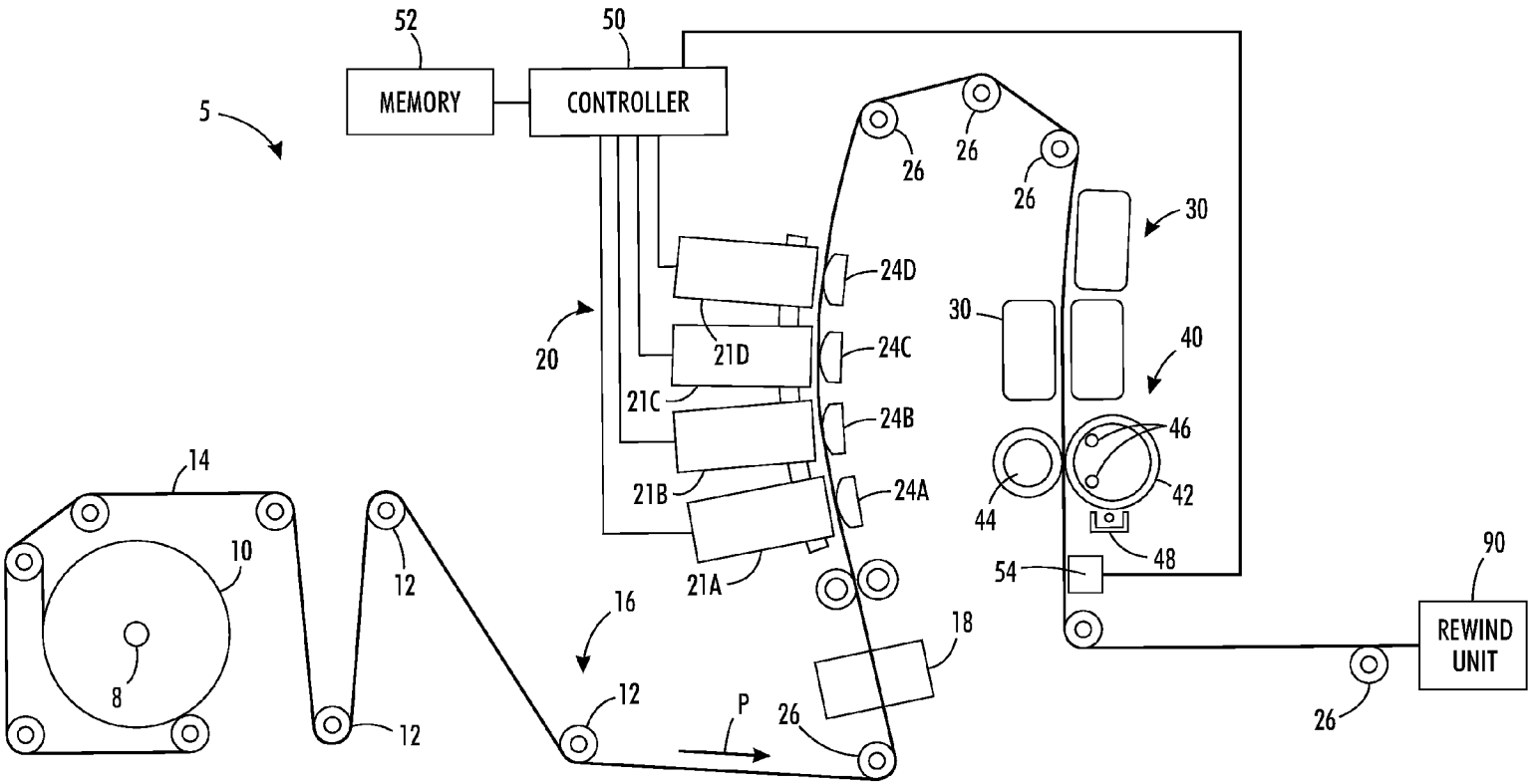
FIG. 4 PRIOR ART
FIG. 4 is a schematic diagram of a prior art continuous feed inkjet printer.

FIG. 4 depicts a prior-art inkjet printer 5. For the purposes of this disclosure, an inkjet printer employs one or more inkjet printheads to eject drops of ink onto a surface of an image receiving member, such as paper, another print medium, or an indirect member, such as a rotating image drum or belt. The printer 5 is configured to print ink images with a "phase-change ink," by which is meant an ink that is substantially solid at room temperature and that transitions to a liquid state when heated to a phase change ink melting temperature for ejecting onto the imaging receiving member surface. The phase change ink melting temperature is any temperature that is capable of melting solid phase change ink into liquid or molten form. In one embodiment, the phase change ink melting temperature is approximately 70° C. to 140° C. In alternative embodiments, the ink utilized in the printer comprises UV curable gel ink. Gel inks are also heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

The printer 5 includes a controller 50 to process the image data before generating the control signals for the inkjet ejectors to eject colorants. Colorants can be ink or any suitable substance, which includes one or more dyes or pigments and which is applied to the media. The colorant can be black or any other desired color, and some printer configurations apply a plurality of different colorants to the media. The media includes any of a variety of substrates, including plain paper, coated paper, glossy paper, or transparencies, among others, and the media can be available in sheets, rolls, or other physical formats.

The printer 5 is an example of a direct-to-web, continuous-media, phase-change inkjet printer that includes a media supply and handling system configured to supply a long (i.e., substantially continuous) web of media 14 of "substrate" (paper, plastic, or other printable material) from a media source, such as spool of media 10 mounted on a web roller 8. The media web 14 includes a large number (e.g. thousands or tens of thousands) of individual pages that are separated into individual sheets with commercially available finishing devices after completion of the printing process. In the example of FIG. 4, the media web 14 is divided into a plurality of forms that are delineated with a series of form indicators that are arranged at predetermined intervals on the media web 14 in the process direction. Some webs include perforations that are formed between pages in the web to promote efficient separation of the printed pages.

Figure 5:
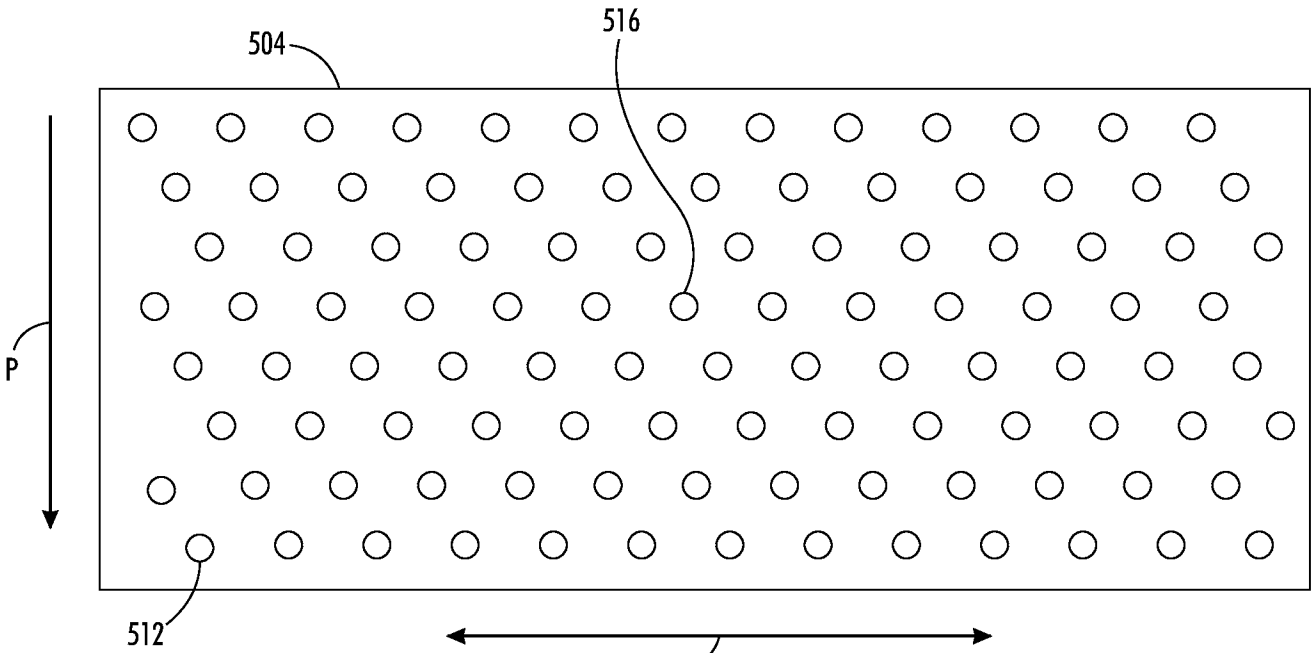
FIG. 5 PRIOR ART
FIG. 5 is a simplified schematic diagram depicting inkjets formed in a face of a prior art printhead used in the printer of FIG. 4.

FIG. 5 is a simplified view of a front face of one of the printheads 504 in one of the printhead units 21A-21D in the printer 5. The printhead 504 includes a plurality of inkjets, and FIG. 5 depicts nozzle openings for the inkjets in the face of the printhead 504. For example, the printhead 504 includes nozzles for inkjets 512 and 516. Each inkjet ejects drops of ink through a corresponding nozzle. The inkjets are arranged in a series of staggered rows. Each row extends in the cross-process direction CP and the rows are arranged in the process direction P. In the printer 5, the printhead face 504 is arranged in close proximity to the media web 14 to enable each inkjet in the printhead to eject ink drops onto the surface of the media web 14. The printhead 504 depicts a small number of inkjets for illustrative purposes. Alternative printhead embodiments include several hundred or thousand inkjets. For example, in one embodiment of the printer 5 each printhead includes 880 inkjets.

Referring again to FIG. 4, the printer 5 includes a media transport using one or more actuators, such as electric motors, to rotate rollers that are arranged along the media path that move the media web 14 in the process direction P at a predetermined linear velocity. In the printer 5, the media web 14 is unwound from the source 10 as needed and a variety of motors, not shown, rotate one or more rollers 12 and 26 to propel the media web 14 in the process direction P. The media conditioner includes rollers 12 and a pre-heater 18. The rollers 12 and 26 control the tension of the unwinding media as the media moves along a path through the printer. In alternative embodiments, the printer transports a cut sheet media through the print zone in which case the media supply and handling system includes any suitable device or structure to enable the transport of cut media sheets along a desired path through the printer. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

The media web 14 continues in the process direction P through the print zone 20 past a series of printhead units 21A, 21B, 21C, and 21D. Each of the printhead units 21A-21D effectively extends across the width of the media and includes one or more printheads that eject ink directly (i.e., without use of an intermediate or offset member) onto the media web 14. In printer 5, each of the printheads ejects a single color of ink, one for each of the colors typically used in color printing, namely, cyan, magenta, yellow, and black (CMYK).

The controller 50 of the printer 5 receives velocity data from encoders mounted proximately to the rollers positioned on either side of the portion of the path opposite the four printheads to calculate the linear velocity and position of the web as the web moves past the printheads. The controller 50 uses the media web velocity data to generate firing signals for actuating the inkjet ejectors in the printheads to enable the printheads to eject four colors of ink with appropriate timing and accuracy for registration of the differently colored patterns to form color images on the media. The inkjet ejectors actuated by the firing signals correspond to digital data processed by the controller 50. The digital data for the images to be printed can be transmitted to the printer, generated by a scanner (not shown) that is a component of the printer, or otherwise generated and delivered to the printer.

Associated with each printhead unit is a backing member 24A-24D, typically in the form of a bar or roll, which is arranged substantially opposite the printhead on the back side of the media. Each backing member positions the media at a predetermined distance from the printhead opposite the backing member. The backing members 24A-24D are optionally configured to emit thermal energy to heat the media to a predetermined temperature, which is in a range of about 40° C. to about 60° C. in printer 5. The various backer members can be controlled individually or collectively. The pre-heater 18, the printheads, backing members 24A-24D (if heated), as well as the surrounding air combine to maintain the media along the portion of the path opposite the print zone 20 in a predetermined temperature range of about 40° C. to 70° C.

As the partially-imaged media web 14 moves to receive inks of various colors from the printheads of the print zone 20, the printer 5 maintains the temperature of the media web 14 within a given range. The printheads in the printhead units 21A-21D eject ink at a temperature typically significantly higher than the temperature of the media web 14. Consequently, the ink heats the media, and temperature control devices can maintain the media web temperature within a predetermined range. For example, the air temperature and air flow rate behind and in front of the media web 14 impacts the media temperature. Accordingly, air blowers or fans can be utilized to facilitate control of the media temperature. Thus, the printer 5 maintains the temperature of the media web 14 within an appropriate range for the jetting of all inks from the printheads of the print zone 20. Temperature sensors (not shown) can be positioned along this portion of the media path to enable regulation of the media temperature.

Following the print zone 20 along the media path are one or more "mid-heaters" 30. A mid-heater 30 can use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 applies heat and/or pressure to the media to fix the images to the media. The fixing assembly includes any suitable device or apparatus for fixing images to the media including heated or unheated pressure rollers, radiant heaters, heat lamps, and the like. In the embodiment of the FIG. 4, the fixing assembly includes a "spreader" 40, which applies a predetermined pressure, and in some implementations, heat, to the media. The function of the spreader 40 is to flatten the individual ink droplets, strings of ink droplets, or lines of ink on web 14 and flatten the ink with pressure and, in some systems, heat. The spreader flattens the ink drops to fill spaces between adjacent drops and form uniform images on the media web 14. In addition to spreading the ink, the spreader 40 improves fixation of the ink image to the media web 14 by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web 14 to a temperature in a range from about 35° C. to about 80° C. In alternative embodiments, the fixing assembly spreads the ink using non-contact heating (without pressure) of the media after the print zone 20. Such a non-contact fixing assembly can use any suitable type of heater to heat the media to a desired temperature, such as a radiant heater, UV heating lamps, and the like.

In one practical embodiment, the roller temperature in spreader 40 is maintained at an optimum temperature that depends on the properties of the ink, such as 55° C. Generally, a lower roller temperature gives less line spread while a higher temperature produces imperfections in the gloss of the ink image. Roller temperatures that are too high may cause ink to offset to the roll. In one practical embodiment, the nip pressure is set in a range of about 500 to about 2000 psi lbs/side. Lower nip pressure produces less line spread while higher pressure may reduce pressure roller life.

The spreader 40 can include a cleaning/oiling station 48 associated with image-side roller 42. The station 48 cleans and/or applies a layer of some release agent or other material to the roller surface. The release agent material can be an amino silicone oil having viscosity of about 10-200 centipoises. A small amount of oil transfers from the station to the media web 14, with the printer 5 transferring approximately 1-10 mg per A4 sheet-sized portion of the media web 14. In one embodiment, the mid-heater 30 and spreader 40 are combined into a single unit with their respective functions occurring relative to the same portion of media simultaneously. In another embodiment, the media is maintained at a high temperature as the media exits the print zone 20 to enable spreading of the ink.

The printer 5 includes an optical sensor 54 that is configured to generate image data corresponding to the surface of the media web 14. The optical sensor 54 is configured to detect, for example, the presence, reflectance values, and/or location of ink drops jetted onto the media web 14 by the inkjets of the printhead assembly. The optical sensor 54 includes an array of optical detectors mounted to a bar or other longitudinal structure that extends across the width of an imaging area on the image receiving member. In one embodiment in which the imaging area is approximately twenty inches (50.8 cm) wide in the cross-process direction and the printheads print at a resolution of 600 dpi in the cross-process direction, over 12,000 optical detectors are arrayed in a single row along the bar to generate a single scanline of image data corresponding to a line across the image receiving member. The controller 50 generates two-dimensional image data from a series of scanlines that the optical sensor 54 generates as the media web 14 move past the optical sensor 54. The optical detectors are configured in association in one or more light sources that direct light towards the surface of the media web 14. The optical detectors receive the light generated by the light sources after the light is reflected from the image receiving member. The magnitude of the electrical signal generated by an optical detector corresponds to an amount of reflected light received by the detector from the bare surface of the media web 14 or ink markings formed on the media web 14. The magnitudes of the electrical signals generated by the optical detectors are converted to digital values by an appropriate analog/digital converter.

In a single imaging operation, the optical sensor 54 generates a single row of image data pixels corresponding to a narrow section of the surface of the media web 14 extending in the cross-process direction. Each row of pixels is referred to as a "scan line" in the image data. Each optical detector in the optical scanner 54 generates a single pixel in the scanline. As the media web 14 moves past the optical sensor 54, the optical sensor 54 continues to generate additional scanlines to form a two-dimensional array of image data pixels formed from multiple scanlines. In the two dimensional image data, a column of pixels that is generated by a single optical detector in the optical scanner 54 in a plurality of scanlines is referred to as a "pixel column" in the image data. Each pixel column extends in the process direction.

In printer 5, the controller 50 is operatively connected to various subsystems and components to regulate and control operation of the printer 5. The controller 50 is implemented with general or specialized programmable processors that execute programmed instructions. The instructions and data required to perform the programmed functions are stored in a memory 52 that is associated with the controller 50. The memory 52 stores programmed instructions for the controller 50. In the configuration of FIG. 4, the memory 52 also stores time offset data for the inkjets in each of the printheads in the print zone 20 using one or more lookup tables (LUTs). As described below, the printer 5 performs a process for process direction registration between inkjets in each of the printheads.

In the controller 50, the processors, their memories, and interface circuitry configure the controllers and/or print zone to perform the printer operations. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits. The controller 50 is operatively connected to the printheads in the printhead units 21A-21D. The controller 50 generates electrical firing signals to operate the individual inkjets in the printhead units 21A-21D to eject ink drops that form printed images on the media web 14. As described in more detail below, the controller 50 receives signals from the optical sensor 54 to generate image data corresponding to test pattern marks formed on the surface of the media web 14. The controller 50 performs process direction registration for the printheads in each of the printhead units 21A-21D to produce high quality printed images on the media web 14.

FIG. 1 is a block diagram of a process 100 for performing process direction registration between ink jets in a printhead. In the discussion below, a reference to the process 100 performing a function or action refers to a controller executing programmed instructions stored in a memory to operate one or more components in a printer to perform the function or action. Process 100 is described in conjunction with the printer 5 for illustrative purposes.

Process 100 begins as the printer 5 moves the print medium along the media path in the process direction P past the printheads in the print zone 20 and the optical sensor 54 at a predetermined linear velocity (block 104). In the printer 5, the controller 50 operates one or more electric motors to rotate the rollers 12 and 26 and move the media web 14 in the process direction at a predetermined velocity. The media web 14 is accelerated to a linear velocity that is the same linear velocity used during an imaging operation for the registration process applied to the printheads in the print zone 20 to accurately reflect the print zone conditions when forming printed images. During process 100, the printer 5 moves the media web 14 at a linear rate that is greater than approximately 137 meters per minute (450 feet per minute) with the printer 5 being configured to move the media web 14 at a rate of approximately 198 meters per minute (650 feet per minute). Alternative printer configurations move an image receiving surface, such as a media web, cut media sheets, drum, or belt past printheads at different linear velocities.

Process 100 continues as the printer ejects a series of ink drops from an inkjet in a printhead onto the image receiving surface at less than a maximum operating rate for the inkjet (block 108). In the printer 5, the controller 50 generates firing signals to operate the inkjet with at a maximum firing frequency rate, which is a rate of 39 KHz in one embodiment of the printer 5. To operate the inkjet at less than the maximum operating rate, the controller 50 only generates firing signals during selected cycles of the maximum operating rate. For example, in one configuration an inkjet 512 in the printhead 504 is operated with a duty cycle of approximately 9.1%, which is to say that the controller 50 generates a firing signal for the inkjet 512 during a first frequency cycle and then waits for ten consecutive frequency cycles before generating the next firing signal for the inkjet to eject the next ink drop in the series. The inkjet 512 is configured to be capable of ejecting an ink drop during each of the intervening ten cycles, but the controller 50 only generates the firing signals at the reduced rate to print a series of individual ink drops with perceptible gaps between the ink drops on the media web 14.

Ejecting ink drops onto the image receiving surface at less than the maximum operating rate of the printhead enables generation of a test pattern on the image receiving surface where the individual ink drops from the inkjet are separated and are identified individually by the optical sensor 54. As described below, as the linear velocity of the media web 14 increases, the resolution of the image data generated by the optical sensor 54 in the process direction becomes much less than the resolution in the cross process direction. Consequently, the ability to extract the position of the drops ejected by the inkjets in the process direction using standard image processing techniques becomes less accurate due to aliasing of the image data that occurs when the media web 14 moves at the predetermined linear velocity.

Printing individual ink drops from the inkjet at less than the maximum operating rate of the inkjet also reduces changes in the drop mass in inkjets due to fluctuations in the flow of ink between multiple inkjets that are each fluidly coupled to a single ink reservoir. The time required for a drop to traverse the gap between the front face of the printhead and the media depends on the size of the drops. In the configuration of the printer 5, larger drops are ejected from each inkjet, such as the inkjets in the printhead face 504, at a higher velocity than smaller ink drops. Thus, the time taken for an ink drop to traverse the gap between the printhead face and the media web 14 is smaller for the larger ink drops that have the higher velocity. The variation in traversal time changes the process direction positions of the ink drops on the media web 14. In one embodiment, at least two factors affect the size of the ink drops. The first factor is the amount of time that has elapsed since the inkjet ejected another ink drop during its operation. The second factor is whether other inkjets, which receive ink from the same finger manifold as the inkjet under consideration, are firing simultaneously with the inkjet under consideration. This latter phenomenon is referred to as "cross-talk." Within a printhead a main manifold is provided to supply all of the inkjets, but finger manifolds, which are positioned between the main manifold and the inkjets, feed some subset of inkjets in the printhead. Because the inkjets are distributed about the printhead in multiple rows, inkjets that fire at the same time do not necessarily end up adjacent to each other on the media. As an individual inkjet is operated multiple times in rapid succession to form dashes in a test pattern, the operation of the inkjet generates some degree of cross-talk for the inkjet and for other neighboring inkjets in the printhead. A test pattern that is formed from isolated drops is free of cross-talk effects if the distance between the individual drops is selected so that only one inkjet receives ink from the same finger manifold in the printhead ejects an ink drop at a given time. Under some conditions, the measurement of the drop position in the absence of cross-talk enables measurement of process direction drop positions with higher accuracy than drops that are printed with a noticeable cross-talk effect. The improved drop placement position measurements improve the accuracy of the inkjet registration within the printhead, which enables the printhead to form higher quality ink images during a print job.

During process 100, the optical sensor 54 generates image data samples and profiles corresponding to the media web 14 and the printed ink drops on the media web 14 as the media web 14 moves past the optical sensor 54 in the process direction (block 112). The optical sensor 54 generates each image data sample as a scanline extending across the media web 14 in the cross-process direction. In each scanline, a single pixel or a small number of pixels in a narrow region of the cross-process direction corresponds to an area of the media web 14 that receives ink drops from one of the inkjets that ejects ink drops to form the test pattern. The controller 50 generates an image data profile that includes pixels from multiple image data sample scanlines that correspond to the single inkjet. The image data profile includes pixels that depict the ink drops on the image receiving surface of the media web 14 as well as pixels that depict the bare surface of the media web 14 between the ink drops.

In the printer 5, the optical sensor 54 includes the plurality of optical detectors that are each configured to generate an image data pixel corresponding to an approximately square region of the surface of the media web 14 with 42 μm by 42 μm dimensions in the process direction and cross-process direction when the media web 14 is stationary. If the media moves a distance of 42 μm between subsequent scanlines as an image is captured, then the optical sensor 54 generates image data with a resolution of approximately 600 spots per inch in both the process direction and cross-process direction During process 100, however, the media web 14 moves past the optical sensor 54 with a linear velocity that reduces the effective resolution of each detector in the optical sensor 54 in the process direction. For example, in one configuration the optical sensor 54 is configured to generate image data samples at a maximum rate of approximately 21,500 scanlines per second. Each of the inkjets in the print zone 20 are configured to eject ink drops at a rate of up to 39,000 drops per second, which is a higher ink drop ejection rate than the maximum scanning rate of the optical sensor 54. Therefore, the resolution of the image data is insufficient to resolve the process direction locations of two adjacent drops. When the media web 14 moves past the optical sensor at a rate of approximately 650 feet per second, the optical sensor 54 is only capable of generating image data at a resolution of approximately 165 scanline spots per inch. Thus, as the linear velocity of the media web 14 increases beyond a predetermined threshold, the effective resolution of the optical sensor 54 decreases.

Figure 2:
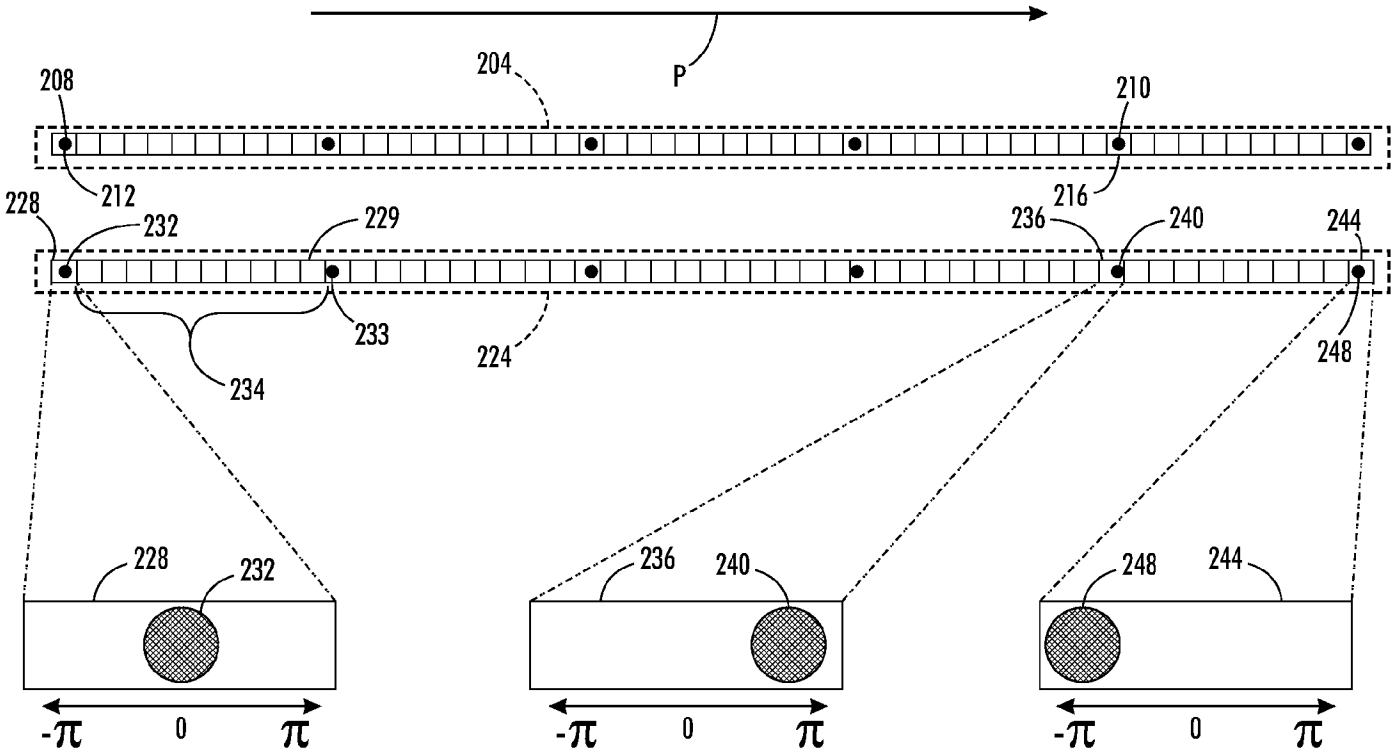
FIG. 2 is a schematic diagram depicting printed ink drops and pixels of image data corresponding to the ink drops as an image receiving surface moves past an optical detector at two different velocities.

FIG. 2 depicts two columns of pixels 204 and 224 that are generated by a single detector in the optical scanner 54 and include ink drops that are arranged in the process direction P on the media web 14. The pixel column 204 is generated when the media web 14 moves past the optical sensor 54 at a linear velocity that enables the optical sensor 54 to generate pixels that are approximately squares with 42 μm by 42 μm dimensions in the process and cross-process directions. The pixel 208 captures an ink drop 212, and other pixels capture ink drops, such as pixel 210 and ink drop 216, or blank regions of the surface of the media web 14. As seen in the pixel column 204, each pixel including an ink drop is separated from the next pixel including another ink drop by ten blank pixels of image data.

In FIG. 2, the pixel column 224 represents image data generated by the optical detector in the optical sensor 54 with ink drops that are arranged with the same number of digital image pixels separating the drops in the process direction P, but the pixels 224 are generated when the media web 14 is moving past the optical sensor 54 at linear velocity that is sufficient to significantly reduce the effective resolution of the detector in the optical sensor 54 in the process direction. In the pixel column 224, the effective size of each pixel in the process direction P increases. If the drops are regularly spaced and the spacing between the drops is not a multiple of the pixel in 224, then the relative location of each ink drop in the pixels, such as ink drops 232 and 240 in pixels 228 and 236, respectively, changes.

As described above, the inkjet ejects ink drops at the first rate that leaves a perceptible gap between adjacent ink drops in the series of printed ink drops. For example, in the pixel column 224, the pixel 228 is an image sample that depicts the ink drops 232 on the image receiving surface, such as the surface of the media web 14. The next ten consecutive image data sample pixels 234 that extend in the process direction P from the pixel 228 each depict a blank portion of the media web 14 that does not contain an ink drop. The image data sample pixel 229 depicts the next ink drop 233 on the surface of the media web 14. Thus, inkjet ejects a series of ink drops that are separated from each other in the process direction by a distance corresponding to at least one image data sample to ensure that the individual image data samples each depict either a single ink drop on the image receiving surface or a blank portion of the image receiving surface that is between the printed ink drops.

When drops 232, 233, and 240 pass under the optical sensor 54, the reflected light has a reduced level of reflectivity when the drop is within the approximately 42 μm field of view and a high level of reflectivity when paper is in the 42 μm field of view. The response of the optical sensor is similar for the pixels that depict each of the drops without regard for the relative location of each drop within the pixel. However, the relative position of the drop within the pixel is different for this set of drops. If a number of drops in the series is chosen so that the relative position of the drop within each pixel is not uniformly distributed across the series of pixels, then the estimate of the drops position is affected by bias due to the relative locations of the ink drops within the pixels. The accuracy of the identified pixel locations is reduced in an effect that is referred to as "aliasing." During process 100, the controller 50 selects the number of pixels of image data to generate for the series of ink drops on the image receiving member so that in the captured image the drops are uniformly distributed across pixels in a pixel column.

For example, in one embodiment a precise spacing between the ink drops in the pixel column 224 is 6.064 pixels. The relative position of the ink drop within each pixel shifts by a distance corresponding to $2\pi\times0.064$ radians within each pixel, where each pixel is represented as a periodic function having a total period of $2\pi$ radians. Thus, a series of fifteen consecutive ink drops with the spacing depicted in FIG. 2 enables the optical sensor 54 to generate image data samples with phases of between 0 radians and an absolute value of 6.03 radians uniformly without introducing a significant bias into the position estimates across the pixels. Under some conditions the ink drop is biased towards the left side of the pixel and under other conditions it is biased towards the right side of the pixel. The bias leads to larger measurement noise and a reduced ability to register the drops within a printhead in the process direction. In one embodiment, the relative phase change between ink drops that are printed in the test pattern is identified empirically for a range of image receiving surface velocities in the printer to identify the number of ink drops to be printed during process 100 for a wide range of print modes.

Consequently, in one embodiment the optical sensor 54 is configured to generate image samples of approximately fifteen ink drops when the generation of fifteen ink drops produces a phase change with a magnitude of approximately $2\pi$ radians. In an alternative embodiment, the inkjet ejects a series of thirty, forty-five, sixty, etc. ink drops that produce a total phase change of $n\times2\pi$ radians, where n is a positive integer value to reduce or eliminate the bias in the image data. As described above, the bias introduced due to aliasing of the image data may introduce inaccuracies in the identified locations of the ink drops in the image data. Using a number of samples that produce a total phase change of close to a multiple of $2\pi$ radians ensures that the image data include pixels generated with approximately equal amounts of opposing biases that tend to cancel the total bias and improve the accuracy of the average process direction locations for all of the ink drops. Thus, even if the process direction locations of individual ink drops in the printed pattern are inaccurate due to aliasing, process 100 generates image data samples for an appropriate number of ink drops to reduce or eliminate the aggregate bias for the ink drops.

Using FIG. 2 as an example, the pixel column 224 includes pixels 228, 236, and 244 that depict ink drops 232, 240, and 248, respectively. As shown in a more detailed view, the ink drop 232 is near the center of the pixel 228, with a phase of approximately zero. The ink drop 240 is offset from the center of the pixel 236 with a phase that is approaching $\pi$ radians, while the ink drop 248 is offset from the center of the pixel 244 with a phase that is approaching $-\pi$ radians. As described above, the inkjet ejects a predetermined number of ink drops that include both positive and negative phase offsets to reduce or eliminate bias in the image data.

Referring again to FIG. 1, after generating the profile of the image data samples corresponding to the media web 14 and the printed ink drops, process 100 continues with application of one or more periodic functions to the image data profile to reduce random noise in the image data and identify a center of the printed ink drops in the process direction (block 116).

Figure 3:
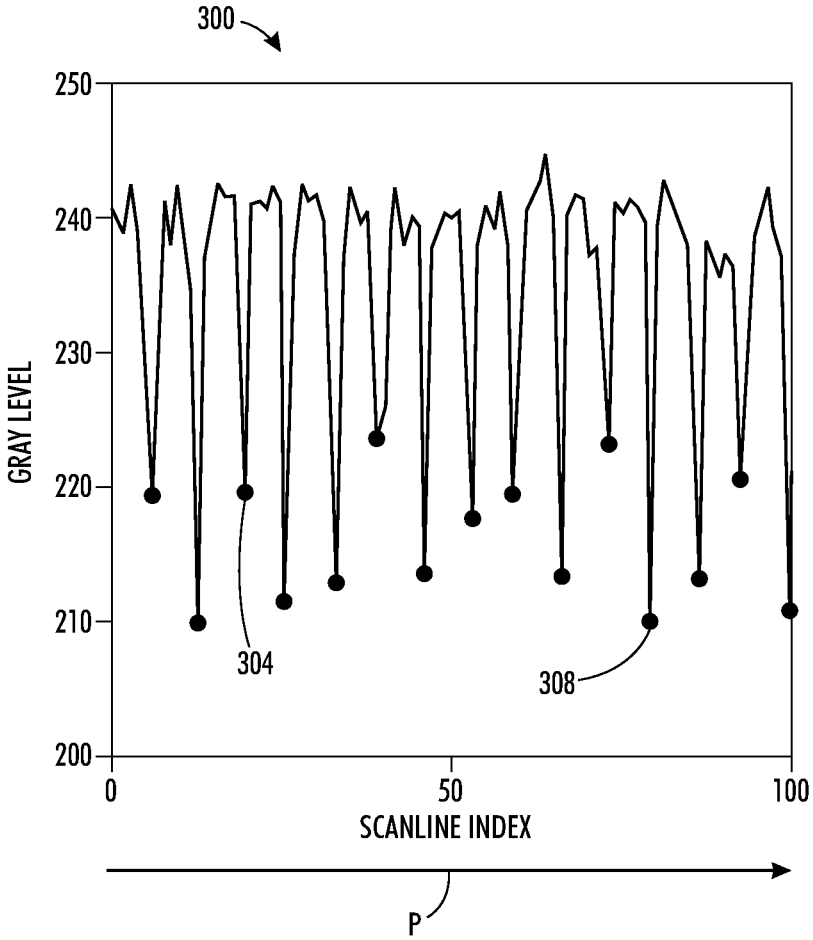
FIG. 3 is a graph depicting identified locations of ink drops in image data corresponding to ink drops that are ejected onto an image receiving surface from a single inkjet.

For example, in one embodiment the controller 50 convolves a center finding kernel with the image data to identify pixel locations for the ink drops. The center finding kernel modifies the profile to identify local minima that correspond to the centers of ink drops and that reduce or eliminate noise and other features that are not related to the drop position. For example, small particles and stray fibers on the surface of the media web 14 may produce image data responses that are similar to a printed ink drop, but the application of the center finding kernel rejects the noise in the image data profile that is generated due to random contaminants since the ink drops are printed in a predetermined pattern with expected spacing between ink drops in the process direction. FIG. 3 depicts a graph 300 with identified pixel locations for pixels in the image data that are identified with the generated profile. The controller 50 uses the profile to improve the identification of pixel locations corresponding ink drops in the process direction P. For example, the controller 50 identifies the locations 304 and 308 in the image data as corresponding to ink drops using the generated profile data.

Referring again to FIG. 1, during process 100 the controller 50 optionally interpolates the profile data corresponding to the printed ink drops to generate estimated locations for the printed ink drops with a higher resolution than is available using the image data that are generated by the optical sensor 54 (block 120). For example, using a quadratic interpolation procedure, the controller 50 generates estimated process-direction locations from the identified locations of the ink drops in the pixel column 224 of FIG. 2 at a higher resolution than the distance between adjacent pixels in the pixel column 224.

After identifying locations for each of the ink drops in the process direction, the controller 50 identifies a center location for the series of printed ink drops in the process direction (block 124). In one embodiment, the controller 50 identifies the center as the average location for each of the identified ink drops in the process direction. The center of the series of drops is typically identified based on a reference location in the process direction, such as a reference scanline of image data, which is used to identify ink drops generated by multiple inkjets in one or more printheads. For example, in FIG. 3 the scanline labeled "0" is a reference scanline from which the controller 50 identifies the relative locations of ink drops that are ejected from multiple inkjets in one or more printheads in the print zone 20.

Process 100 continues as the controller 50 identifies a process direction offset between the identified center of the ink drops ejected by the inkjet and another center of ink drops that are ejected by a reference inkjet (block 128). For example, in the printhead 500 the inkjet 516 is selected as a reference inkjet, and the controller 50 is configured to adjust the time of operation for other inkjets in the printhead 504, such as the inkjet 512, with reference to ink drops that are ejected from the inkjet 516. During process 100, the controller 50 identifies a process direction location for the center of ink drops that are ejected from the inkjet 516 as described above. The controller 50 also identifies offsets in the process direction between the location of the center identified for the reference inkjet 516 and other inkjets in the printhead 504, such as the inkjet 512. For example, the controller 50 identifies an offset in the process direction between the inkjets 512 and 516 as a number of pixels in the process direction or as a linear dimension in the process direction.

The controller 50 converts the offset value from a linear measurement to a number of digital image pixels with reference to the predetermined linear velocity of the media web 14 and stores the image data offset value in a memory to adjust the operation of the inkjet during printing operations (block 132). For example, if the controller 50 identifies that the offset between the reference inkjet 516 and the inkjet 512 is approximately 254 μm, which corresponds to an offset of three pixels in the example given above when the media web 14 has a linear velocity of 3.3 meters per second (198 meters per minute). In the printer 5, the controller 50 stores a digital image data offset value corresponding to the three-pixel offset in the memory 52 in association with the identified inkjet 512. In one embodiment, the digital offset value has a positive value to delay the operation of the inkjet 512 if the inkjet 512 ejects the ink drops too early relative to the inkjet 516 and a negative value to bring forward the operation of the inkjet 512 if the inkjet 512 ejects the ink drops too late relative to the inkjet 516. During a printing operation, the controller 50 adjusts the locations of pixels in the digital image data corresponding to each inkjet with reference to the pixel offset data that are stored in the memory 52. The controller 50 generates the firing signals for each of the inkjets using the modified image data to enable inkjets in each of the printheads to form printed images with proper process direction registration.

While process 100 is described above with reference to a single printhead, the printer 5 is configured to perform process 100 for each printhead in the print zone for process direction registration of inkjets in each printhead. In some embodiments, the process 100 is performed between imaging operations during a print job when the printer 5 identifies and corrects for process direction registration errors while forming printed images on the media web 14. In the printer 5, the controller 50 operates the inkjet to eject the ink drops onto the media web 14 in an inter-document zone (IDZ), which is a blank region of the media web 14 located between two printed images that are formed during a print job. The printer 5 can print test patterns in multiple IDZs during a print job to maintain process direction registration for the inkjets in each of the printheads in the print zone 20.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed:

1. A method for registration of an inkjet in a printhead comprising:

moving an image receiving surface in a process direction past a printhead and an optical sensor;

ejecting a plurality of drops from a first inkjet in the printhead at a first predetermined rate onto the image receiving surface, the first rate of ejecting the ink drops from the first inkjet being less than a maximum ejection rate of the first inkjet;

generating with the optical sensor a plurality of image data samples of the image receiving surface including a plurality of portions of the image receiving surface that received the plurality of drops ejected from the first inkjet, the plurality of image data samples being generated at a second predetermined rate, the second predetermined rate being less than the maximum ejection rate of the first inkjet to enable at least one image data sample between two image data samples depicting an ink drop to depict a portion of the image receiving surface that does not have an ink drop;

identifying a center of the plurality of ink drops on the image receiving surface in the process direction with reference to the plurality of image data samples;

identifying a process direction offset between the identified center of the plurality of drops ejected from the first inkjet and a center identified with reference to another plurality of image data samples generated for another portion of the image receiving surface having a plurality of ink drops that were ejected by a second inkjet; and storing in a memory in association with the first inkjet an image data offset value corresponding to the identified offset.

2. The method of claim 1 further comprising:

moving the image receiving surface past the optical sensor at a predetermined linear velocity to enable generation of each image data sample with a dimension in the process direction that is larger than a size of each one of the plurality of ink drops on the image receiving surface.

3. The method of claim 2 further comprising:

identifying the first rate for ejecting the ink drops from the first inkjet with reference to the process direction dimension for each image data sample and a size of a relative change in the process direction location of a first ink drop and a second ink drop in the plurality of ink drops that correspond to a first image data sample that includes the first ink drop and a second image data sample that includes the second ink drop.

4. The method of claim 3, the identification of the first rate further comprising:

identifying the first rate for ejecting the ink drops from the first inkjet with reference to the second predetermined rate for generating the image data samples.

5. The method of claim 3 further comprising:

identifying a number of ink drops that are ejected from the first inkjet with a cumulative change between a first relative process direction location of a first ink drop in a first portion of the image receiving surface corresponding to a first image data sample and a second relative process direction location of a second ink drop in a second portion of the image receiving surface being less than the process direction dimension of each portion of the image receiving member corresponding to each image data sample; and generating the image data samples to include only the identified number of ink drops.

6. The method of claim 5, the ejection of the first plurality of ink drops further comprising:

ejecting only the identified number of ink drops from the first inkjet at the first rate.

7. The method of claim 2 wherein the predetermined linear velocity of the image receiving surface is greater than 137 meters per minute.

8. The method of claim 1, the identification of the center of the plurality of ink drops in the process direction further comprising:

generating a profile of the plurality of the image data samples associated with the first inkjet;

convolving the profile with a kernel to decrease noise in the profile; and identifying the center of the plurality of ink drops in the process direction with reference to the convolution.

9. The method of claim 8 further comprising:

interpolating process direction locations of the plurality of ink drops that are identified from the profile for the plurality of ink drops with a resolution that is higher than a resolution of the optical sensor in the process direction; and identifying the center of the plurality of drops in the process direction with reference to the estimated process direction locations for the plurality of ink drops.

10. An inkjet printer comprising:

a media transport configured to move a print medium in a process direction past a printhead having a plurality of inkjets and an optical sensor;

a controller operatively connected to the media transport, the printhead, the optical sensor, and a memory, the controller being configured to:

operate the media transport to move the print medium past the printhead and the optical sensor at a predetermined rate;

generate firing signals to eject a plurality of drops from a first inkjet in the printhead at a first predetermined rate onto the print medium, the first rate of ejecting the ink drops from the first inkjet being less than a maximum ejection rate of the first inkjet;

generate with the optical sensor a plurality of image data samples of the print medium including a plurality of portions of the print medium that received the plurality of drops ejected from the first inkjet, the plurality of image data samples being generated at a second predetermined rate, the second predetermined rate being less than the maximum ejection rate of the first inkjet to enable at least one image data sample between two image data samples depicting an ink drop to depict a portion of the image receiving surface that does not have an ink drop;

identify a center of the plurality of ink drops on the print medium in the process direction with reference to the plurality of image data samples;

identify a process direction offset between the identified center of the plurality of drops ejected from the first inkjet and a center identified with reference to another plurality of image data samples generated for another portion of the image receiving surface having another plurality of ink drops ejected by a second inkjet; and store a timing adjustment value corresponding to the identified offset in the memory in association with the first inkjet.

11. The printer of claim 10, the controller being further configured to:

operate the media transport to move the print medium past the optical sensor at a predetermined linear velocity to enable generation of each image data sample with a dimension in the process direction that is larger than a size of each one of the plurality of ink drops on the print medium.

12. The printer of claim 11, the controller being further configured to:

generate a profile with reference to the plurality of image data samples associated with the first inkjet;

convolve the profile with a kernel to decrease noise in the profile; and identify the center of the plurality of ink drops in the process direction with reference to the convolution.

13. The printer of claim 12, the controller being further configured to:

interpolate process direction locations of the plurality of ink drops that are identified in the profile to generate estimated process direction locations for the plurality of ink drops with a resolution that is higher than a resolution of the optical sensor in the process direction; and identify the center of the plurality of drops in the process direction with reference to the estimated process direction locations for the plurality of ink drops.

14. The printer of claim 10, the controller being further configured to:

identify the first rate for ejecting the ink drops from the first inkjet with reference to the process direction dimension for each image data sample and a size of a relative change in the process direction location of a first ink drop and a second ink drop in the plurality of ink drops that correspond to a first image data sample that includes the first ink drop and a second image data sample that includes the second ink drop.

15. The printer of claim 14, the controller being further configured to:

identify the first rate for ejecting the ink drops from the first inkjet with reference to the second predetermined rate for generating the image data samples.

16. The printer of claim 15, the controller being further configured to:

identify a number of ink drops that are ejected from the first inkjet with a cumulative change between a first relative process direction location of a first ink drop in a first portion of the print medium corresponding to a first image data sample and a second relative process direction location of a second ink drop in a second portion of the print medium being less than the process direction dimension of each portion of the print medium corresponding to each image data sample; and generate the image data samples with the optical sensor to include only the identified number of ink drops.

17. The printer of claim 16, the controller being further configured to:

generate a number of firing signals for the first inkjet to eject only the identified number of ink drops from the first inkjet at the first rate.

18. The printer of claim 10, wherein the media transport is configured to move the print medium in the process direction with a linear velocity that is greater than 137 meters per minute.

* * * * *